US011145187B2

(12) United States Patent
Chen

(10) Patent No.: US 11,145,187 B2
(45) Date of Patent: Oct. 12, 2021

(54) INTEGRATED FIRE ALARM METHOD AND SYSTEM

(71) Applicant: Climax Technology Co., Ltd., Taipei (TW)

(72) Inventor: Yi-Kai Chen, Taipei (TW)

(73) Assignee: Climax Technology Co., Ltd., Taipei (TW)

( * ) Notice: Subject to any disclaimer, the term of this patent is extended or adjusted under 35 U.S.C. 154(b) by 36 days.

(21) Appl. No.: 16/730,803

(22) Filed: Dec. 30, 2019

(65) Prior Publication Data

US 2021/0201658 A1 Jul. 1, 2021

(51) Int. Cl.

| | |
|---|---|
| ***G08B 29/18*** | (2006.01) |
| ***G08B 17/06*** | (2006.01) |
| ***G08B 17/117*** | (2006.01) |
| ***G08B 17/11*** | (2006.01) |

(52) U.S. Cl.

CPC ..... *G08B 29/185* (2013.01); *G08B 17/06* (2013.01); *G08B 17/11* (2013.01); *G08B 17/117* (2013.01); *G08B 29/183* (2013.01)

(58) Field of Classification Search

CPC .... G08B 29/183; G08B 29/185; G08B 17/00; G08B 17/06; G08B 17/10; G08B 17/11; G08B 17/117; G08B 25/002; G08B 25/008; G08B 25/08; G08B 25/10; G08B 3/10; G08B 21/14; G08B 21/182

See application file for complete search history.

(56) References Cited

U.S. PATENT DOCUMENTS

2009/0033505 A1* 2/2009 Jones ..... G08B 25/10 340/584
2013/0154823 A1* 6/2013 Ostrer ..... G08B 29/22 340/539.1
2015/0096352 A1* 4/2015 Peterson ..... G08B 29/02 73/31.02
2016/0012714 A1* 1/2016 Patenaude ..... G08B 25/009 340/539.17
2016/0078751 A1* 3/2016 Sloo ..... G01V 8/10 340/506
2016/0335884 A1* 11/2016 Fadell ..... G01N 33/0031
2017/0132906 A1 5/2017 Peterson et al.

FOREIGN PATENT DOCUMENTS

DE 212014000146 U1 2/2016
WO WO2011/057465 A1 5/2011

OTHER PUBLICATIONS

Extended European Search Report dated Jul. 16, 2020 in related European Application No. 20150875.1.

* cited by examiner

*Primary Examiner* — Orlando Bousono
(74) *Attorney, Agent, or Firm* — Donald E. Stout; Stout, Uxa & Buyan, LLP

(57) ABSTRACT

An integrated fire alarm method includes receiving a preliminary detection signal from a preliminary detector, and comparing the preliminary detection signal with a predetermined corresponding threshold; controlling a notification device to issue an early-warning notification if the preliminary detection signal is greater than the corresponding threshold; receiving a primary detection signal from a primary detector after issuing the early-warning notification, and comparing the primary detection signal with predetermined corresponding threshold; and controlling the notification device to issue a formal notification if the primary detection signal is greater than the corresponding threshold.

16 Claims, 3 Drawing Sheets

INTEGRATED FIRE ALARM METHOD AND SYSTEM

BACKGROUND OF THE INVENTION

1. Field of the Invention

The present invention generally relates to a fire alarm, and more particularly to an integrated fire alarm system and method.

2. Description of Related Art

A smoke detector is one type of fire alarm that issues a sound or a flash of light indicating fire when it senses smoke. However, conventional fire alarms usually issue false or nuisance alarms due to their limited detection capability. Therefore, manpower is commonly wasted, and the fire alarms may lose their credibility. More importantly, people may have doubt about the alarm issued by the fire alarm when a real fire happens, thereby losing an opportunity to put out a fire or to escape.

Although the rate of occurring false alarms may be reduced by decreasing sensitivity or increasing triggered threshold of the fire alarm, time to alert people to a fire may thus be delayed. On the contrary, the rate of occurring false alarms would be increased if the sensitivity is increased or the triggered threshold is reduced. When multiple fire alarms are employed, people may be confused when some fire alarms have issued alarms while other fire alarms have not.

For the foregoing reasons, a need has arisen to propose a novel fire alarm scheme to overcome drawbacks of the conventional fire alarms and to reduce the rate of false alarms.

SUMMARY OF THE INVENTION

In view of the foregoing, it is an object of the embodiment of the present invention to provide an integrated fire alarm system and method capable of effectively reducing the rate of false alarms and enhancing credibility of the fire alarm.

According to one embodiment, an integrated fire alarm method provides at least two fire detectors of different types for respectively detecting different physical properties, and provides at least one notification device. One of the at least two fire detectors is selected as a preliminary detector and remaining at least one fire detector as a primary detector. A preliminary detection signal is received from the preliminary detector, and is compared with a predetermined corresponding threshold; at least one notification device is controlled to issue an early-warning notification if the preliminary detection signal is greater than the corresponding threshold. A primary detection signal is received from the primary detector after issuing the early-warning notification, and is compared with a predetermined corresponding threshold; the at least one notification device is controlled to issue a formal notification if the primary detection signal is greater than the corresponding threshold.

DETAILED DESCRIPTION OF THE INVENTION

Figure 1:
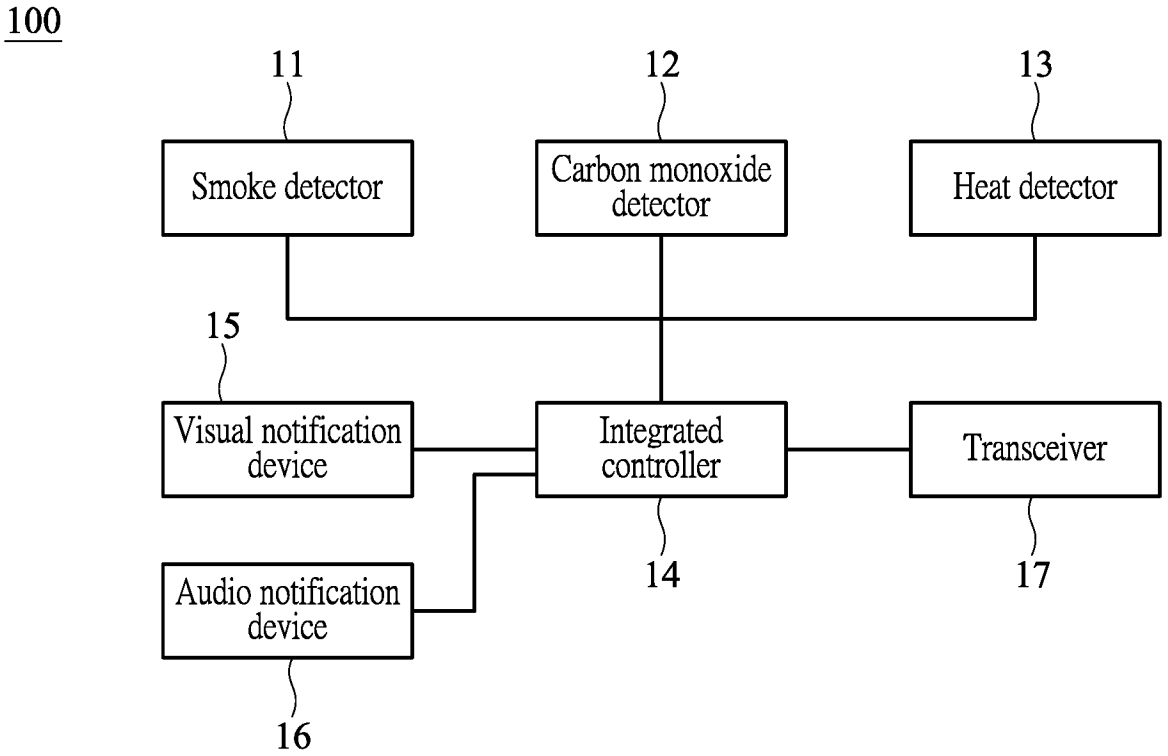
FIG. 1 shows a block diagram illustrating an integrated fire alarm system according to one embodiment of the present invention.

FIG. 1 shows a block diagram illustrating an integrated fire alarm system 100 according to one embodiment of the present invention. According to one aspect of the embodiment, the integrated fire alarm system (system hereinafter) 100 may include at least two fire detectors of different types for respectively detecting different physical properties or matters. An amount of the fire detector(s) of each type may be one or a plurality (for example, disposed on different floors in the building).

In the embodiment, the fire detectors may include a smoke detector 11, a carbon monoxide detector 12 and a heat (or temperature) detector 13. Specifically, the smoke detector 11 can detect a concentration of smoke, for example, by photoelectric effect or ionization process; the carbon monoxide detector 12 can detect a concentration of carbon monoxide, for example, by chemical transduction process; and the heat detector 13 can detect temperature or a (calculated) rate of temperature rise, for example, by thermoelectric effect.

The system 100 of the embodiment may include an integrated controller 14 coupled to receive detection signals from the smoke detector 11, the carbon monoxide detector 12 and the heat detector 13, the detection signals indicating physical quantities of the detected physical properties, respectively. In the embodiment, the system 100 may include at least one notification device, such as visual notification device 15 and/or audio notification device 16, coupled to and controlled by the integrated controller 14 to timely issue a visual notification (e.g., flash of light) and/or an audio notification (e.g., sound or voice). According to another aspect of the embodiment, the visual notification device 15 and/or the audio notification device 16 is controlled by the integrated controller 14, instead of controlled by the detector as in the conventional system.

The system 100 of the embodiment may include a transceiver 17, coupled to the integrated controller 14, for communicating with an external (e.g., outdoor) system such that status of the system 100 may be transferred to other system or status of other system may be received. In one example, the other system may be a mobile device such as mobile phone. The transceiver 17 of the embodiment may be a wired transceiver or a wireless transceiver. According to a further aspect of the embodiment, the transceiver is controlled by the integrated controller 14, instead of controlled by the detector as in the conventional system. The smoke detector 11, the carbon monoxide detector 12, the heat detector 13, the integrated controller 14, the visual notification device 15, the audio notification device 16 and the transceiver 17 as set forth above may be disposed in the same indoor area or in a mobile device such as mobile phone.

Figure 2:
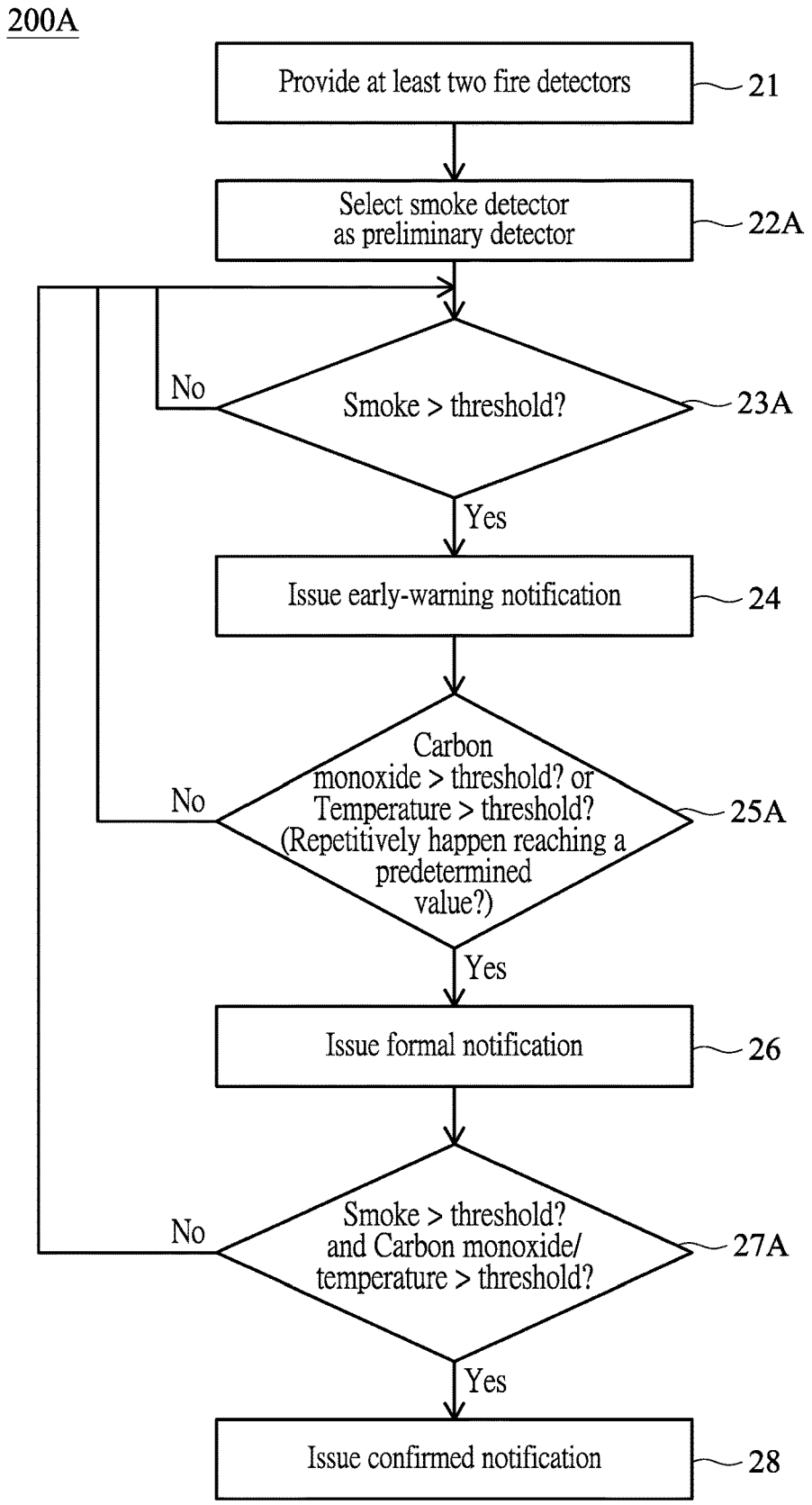
FIG. 2 shows a flow diagram illustrating an integrated fire alarm method according to one embodiment of the present invention.

FIG. 2 shows a flow diagram illustrating an integrated fire alarm method 200A, which may be executed by the integrated controller 14, according to one embodiment of the present invention. Specifically, in step 21, at least two fire detectors of different types for respectively detecting different physical properties or matters may be provided. As exemplified in FIG. 1, the fire detectors may include a smoke detector 11, a carbon monoxide detector 12 and a heat detector 13. Moreover, at least one notification device (e.g., visual notification device 15 and audio notification device 16 as exemplified in FIG. 1) may be provided.

In step 22A, one of the at least two fire detectors may be selected as a preliminary detector, and remaining at least one fire detector as a primary detector. In the embodiment, the smoke detector 11 is selected as the preliminary detector, and the carbon monoxide detector 12 or the heat detector 13 as the primary detector.

In step 23A, the integrated controller 14 may receive a preliminary detection signal from the preliminary detector, and compare the preliminary detection signal with a predetermined first threshold. If the preliminary detection signal is greater than the first threshold, the integrated controller 14 may control at least one notification device to issue an early-warning notification (step 24).

In the embodiment, the integrated controller 14 may receive a preliminary detection signal (representing a detected concentration of smoke) from the smoke detector 11. If the concentration of smoke is greater than the first threshold, the integrated controller 14 may control the visual notification device and/or the audio notification device 16 to issue an early-warning notification. At the same time, the integrated controller 14 may control the transceiver 17 to transfer the early-warning notification to other system (e.g., mobile deice).

Next, in step 25A, the integrated controller 14 may receive a primary detection signal from the at least one primary detector, and compare the primary detection signal with a predetermined (second/third) threshold. If the primary detection signal is greater than the corresponding (second/third) threshold, the integrated controller 14 may control at least one notification device to issue a formal notification (step 26), which is used to replace the early-warning notification. Otherwise, if the determination of step 25A is negative, the flow goes back to step 23A. In another embodiment, if steps 23A-24-25A (i.e., the early-warning notification is issued but step 25A is negative) repetitively happen for several times reaching a predetermined value, the flow goes to step 26.

In the embodiment, the integrated controller 14 may receive a primary detection signal (representing a detected concentration of carbon monoxide) from the carbon monoxide detector 12, and/or may receive a primary detection signal (representing detected temperature or a calculated rate of temperature rise) from the heat detector 13. If the concentration of carbon monoxide is greater than the second threshold or the temperature is greater than the third threshold, the integrated controller 14 may control the visual notification device 15 and/or the audio notification device 16 to issue a formal notification. At the same time, the integrated controller 14 may control the transceiver 17 to transfer the formal notification to other system (e.g., mobile deice). It is appreciated that light or sound issued by the visual notification device 15 or the audio notification device 16 may be different from that of the early-warning notification to make the differentiation.

Subsequently, in step 27A, the integrated controller 14 may continuingly receive the preliminary detection signal (from the preliminary detector), which is compared with the first threshold, and continuingly receive the primary detection signal (from the primary detector), which is compared with the corresponding (second/third) threshold. If the preliminary detection signal is greater than the first threshold, and the primary detection signal is greater than the corresponding (second/third) threshold, the integrated controller 14 may control at least one notification device to issue a confirmed notification (step 28), which is used to replace the formal notification. Otherwise, if the determination of step 27A is negative, the flow goes back to step 23A.

In the embodiment, the integrated controller 14 may continuingly receive a preliminary detection signal (representing a detected concentration of smoke) from the smoke detector 11; continuingly receive a primary detection signal (representing a detected concentration of carbon monoxide) from the carbon monoxide detector 12; and/or continuingly receive a primary detection signal (representing detected temperature or a calculated rate of temperature rise) form the heat detector 13. If the concentration of smoke is greater than the first threshold, and either the concentration of carbon monoxide is greater than the second threshold or the temperature is greater than the third threshold, the integrated controller 14 may control the visual notification device 15 and/or the audio notification device 16 to issue a confirmed notification. At the same time, the integrated controller 14 may control the transceiver 17 to transfer the confirmed notification to other system (e.g., mobile deice). It is appreciated that light or sound issued by the visual notification device 15 or the audio notification device 16 may be different from that of the early-warning or formal notification to make the differentiation.

Figure 3:
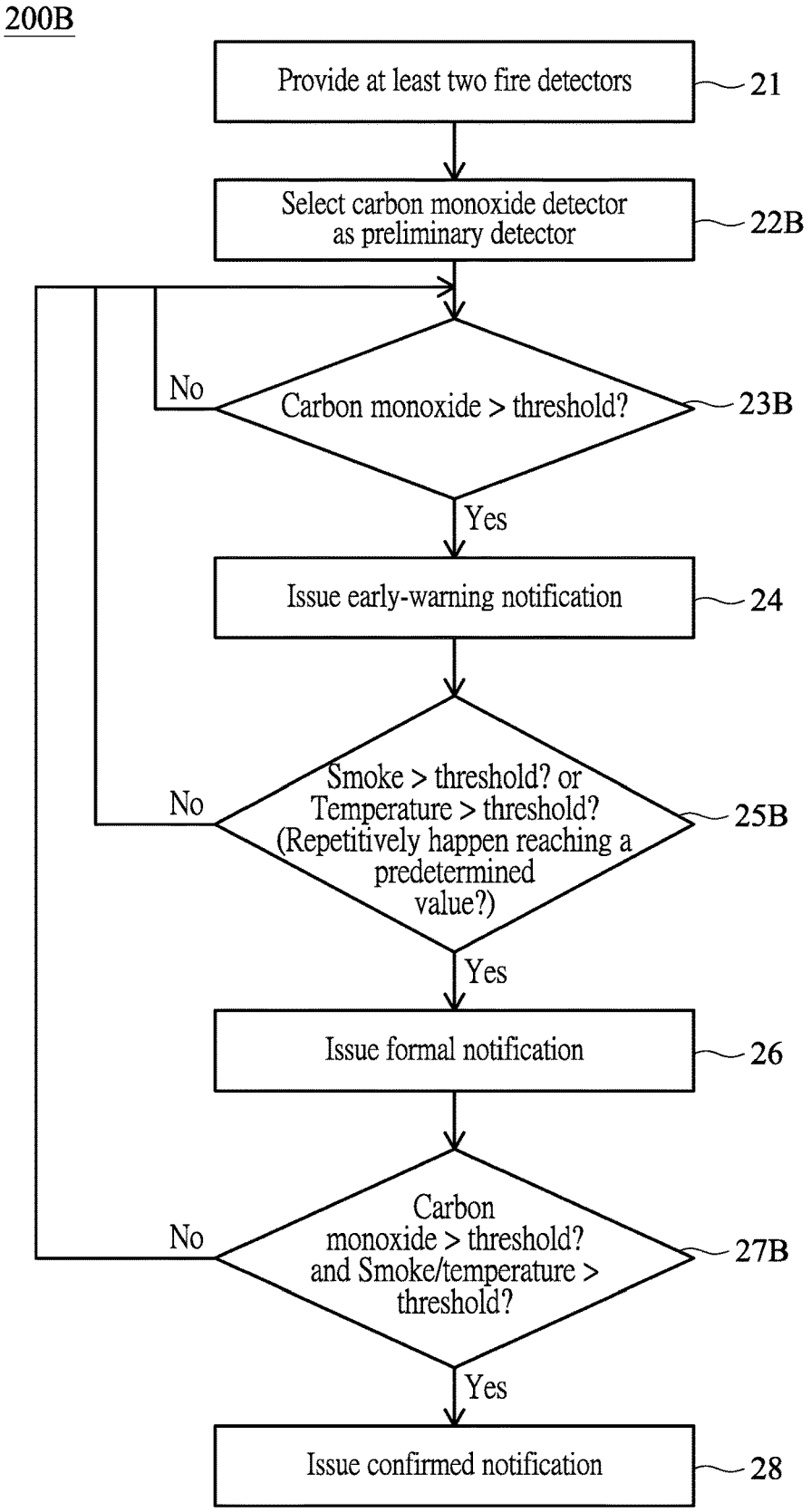
FIG. 3 shows a flow diagram illustrating an integrated fire alarm method according to another embodiment of the present invention.

FIG. 3 shows a flow diagram illustrating an integrated fire alarm method 200B, which may be executed by the integrated controller 14, according to another embodiment of the present invention. The integrated fire alarm method 200B of the present embodiment is similar to the integrated fire alarm method 200A of the preceding embodiment (FIG. 2) with the following exceptions.

In the embodiment, in step 22B, the carbon monoxide detector 12 is selected as the preliminary detector, and the smoke detector 11 or the heat detector 13 as the primary detector. In step 23B, if the concentration of carbon monoxide is greater than the second threshold, the integrated controller 14 may control at least one notification device to issue an early-warning notification (step 24). In step 25B, if a concentration of smoke is greater than the first threshold or temperature is greater than the third threshold, the integrated controller 14 may control at least one notification device to issue a formal notification (step 26). In step 27B, if a concentration of carbon monoxide is greater than the second threshold, and either a concentration of smoke is greater than the first threshold or temperature is greater than the third threshold, the integrated controller 14 may control at least one notification device to issue a confirmed notification. According to the embodiments, the smoke detector 11 is selected as the preliminary detector while remaining at least one detector as the primary detector in the integrated fire alarm method 200A (FIG. 2), or the carbon monoxide detector 12 is selected as the preliminary detector while remaining at least one detector as the primary detector in the integrated fire alarm method 200B (FIG. 3). However, in a further embodiment (not shown), the heat detector 13 may be selected as the preliminary detector while remaining at least one detector as the primary detector.

Although specific embodiments have been illustrated and described, it will be appreciated by those skilled in the art that various modifications may be made without departing from the scope of the present invention, which is intended to be limited solely by the appended claims.

What is claimed is:

1. An integrated fire alarm method, comprising:

providing at least two fire detectors of different types for respectively detecting different physical properties;

providing at least one notification device;

selecting one of the at least two fire detectors as a preliminary detector and remaining at least one fire detector as a primary detector, the preliminary detector and the primary detector being different types of fire detectors;

receiving a preliminary detection signal from the preliminary detector, and comparing the preliminary detection signal with a predetermined corresponding threshold;

controlling at least one notification device to issue an early-warning notification if the preliminary detection signal is greater than the corresponding threshold;

receiving a primary detection signal from the primary detector after issuing the early-warning notification, and comparing the primary detection signal with a predetermined corresponding threshold; and controlling the at least one notification device to issue a formal notification if the primary detection signal is greater than the corresponding threshold.

2. The method of claim 1, after issuing the formal notification, further comprising a step of controlling the at least one notification device to issue a confirmed notification, if the preliminary detection signal is continuingly greater than the corresponding threshold, and the primary detection signal is greater than the corresponding threshold.

3. The method of claim 2, further comprising a step of transferring the early-warning notification, the formal notification or the confirmed notification.

4. The method of claim 1, wherein the at least one notification device comprises a visual notification device or an audio notification device.

5. The method of claim 1, wherein the at least two fire detectors comprise a smoke detector, a carbon monoxide detector and a heat detector.

6. The method of claim 5, wherein the smoke detector is selected as the preliminary detector, and the carbon monoxide detector or the heat detector as the primary detector.

7. The method of claim 5, wherein the carbon monoxide detector is selected as the preliminary detector, and the smoke detector or the heat detector as the primary detector.

8. The method of claim 1, wherein the formal notification is issued if the early-warning notification is issued but the primary detection signal is not greater than the corresponding threshold, which repetitively happens for several times reaching a predetermined value.

9. An integrated fire alarm system, comprising:

at least two fire detectors of different types for respectively detecting different physical properties, one of the at least two fire detectors being selected as a preliminary detector and remaining at least one fire detector as a primary detector, the preliminary detector and the primary detector being different types of fire detectors;

at least one notification device; and an integrated controller coupled to the at least two fire detectors and the at least one notification device;

wherein the integrated controller receives a preliminary detection signal from the preliminary detector and compares the preliminary detection signal with a predetermined corresponding threshold, and the integrated controller controls the at least one notification device to issue an early-warning notification if the preliminary detection signal is greater than the corresponding threshold;

the integrated controller receives a primary detection signal from the primary detector after issuing the early-warning notification and compares the primary detection signal with a predetermined corresponding threshold, and the integrated controller controls the at least one notification device to issue a formal notification if the primary detection signal is greater than the corresponding threshold.

10. The system of claim 9, after issuing the formal notification, wherein the integrated controller further controls the at least one notification device to issue a confirmed notification, if the preliminary detection signal is continuingly greater than the corresponding threshold, and the primary detection signal is greater than the corresponding threshold.

11. The system of claim 10, further comprising a transceiver coupled to the integrated controller to transfer the early-warning notification, the formal notification or the confirmed notification.

12. The system of claim 9, wherein the at least one notification device comprises a visual notification device or an audio notification device.

13. The system of claim 9, wherein the at least two fire detectors comprise a smoke detector, a carbon monoxide detector and a heat detector.

14. The system of claim 13, wherein the smoke detector is selected as the preliminary detector, and the carbon monoxide detector or the heat detector as the primary detector.

15. The system of claim 13, wherein the carbon monoxide detector is selected as the preliminary detector, and the smoke detector or the heat detector as the primary detector.

16. The system of claim 9, wherein the formal notification is issued if the early-warning notification is issued but the primary detection signal is not greater than the corresponding threshold, which repetitively happens for several times reaching a predetermined value.

* * * * *